US008087773B2

(12) United States Patent
Bober et al.

(10) Patent No.: US 8,087,773 B2
(45) Date of Patent: Jan. 3, 2012

(54) INK JET PRINTING DEPTH OF FOCUS CONTROL APPARATUS

(75) Inventors: Henry T Bober, Fairport, NY (US); Linn C Hoover, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 361 days.

(21) Appl. No.: 12/471,778

(22) Filed: May 26, 2009

(65) Prior Publication Data

US 2010/0302331 A1 Dec. 2, 2010

(51) Int. Cl.
*B41J 2/01* (2006.01)

(52) U.S. Cl. ..... 347/104; 347/101

(58) Field of Classification Search ..... 347/8, 104
See application file for complete search history.

(56) References Cited

U.S. PATENT DOCUMENTS

| | | | | |
|---|---|---|---|---|
| 5,636,929 | A * | 6/1997 | Asano et al. | 400/641 |
| 5,850,233 | A * | 12/1998 | Otsuka et al. | 346/136 |
| 6,672,705 | B2 * | 1/2004 | Kitahara et al. | 347/42 |
| 7,486,420 | B2 | 2/2009 | McCrea et al. | |
| 7,661,674 | B2 * | 2/2010 | Izuchi et al. | 271/274 |
| 2004/0160475 | A1 * | 8/2004 | Satoh et al. | 347/36 |
| 2007/0046720 | A1 * | 3/2007 | Konno et al. | 347/21 |

* cited by examiner

*Primary Examiner* — Matthew Luu
*Assistant Examiner* — Renee Wilson

(57) ABSTRACT

A system for maintaining depth of focus in an ink jet printer between a series of print heads and corrugated media includes a vacuum transport in combination with an acquisition cylinder positioned upstream of the series of print heads in order to help the vacuum transport acquire the corrugated media and work in conjunction with a series of star wheels distributed about and positioned immediately adjacent to each of the series of print heads to suppress cross process direction curl.

19 Claims, 4 Drawing Sheets

INK JET PRINTING DEPTH OF FOCUS CONTROL APPARATUS

This disclosure relates to media handling systems, and more specifically, to an improved apparatus for flattening corrugated media passing through the print zone of an ink jet printer.

Flexographic printing as shown, for example, in U.S. Pat. No. 7,486,420 is the major process used to print packaging materials. Flexography is used to print corrugated containers, folding cartons, corrugated board displays, multiwall sacks, paper sacks, plastic bags, milk cartons, disposable cups and containers, labels, etc. In the typical flexographic printing sequence, the substrate is fed into a press from a roll or pre-cut board. The image is printed as the substrate is pulled through a series of flexographic cylinders, or stations, or print units. Each print unit is printing a single color. Unlike traditional cylinder based ink transfer technologies for printing of corrugated materials, such as Flexography, digital ink jet printing requires that the corrugated media be held flat and be precisely spaced from the print head plane throughout the entire print zone. Depths of Focus (DoF) gaps of the order of 1.0±0.2 mm are typical and they are difficult to achieve and maintain across a large area. Variations in this critical gap cause Time of Flight errors in pixel placement onto the moving media and degrade image quality. Since corrugated material is quite stiff any residual curl in boards of the material is difficult to suppress over a large area. In digital ink jet printing of corrugated material, the print zone area is measured in square feet and not a narrow band of a few square inches as with a Flexographic cylinder. Suppressing the curl and holding the corrugated boards flat is a challenge. If the curl is concaved toward the print heads no amount of vacuum can ever flatten the edges. If the curl is concaved away from the print heads, then a vacuum transport can suppress the 'hump' if pressure is adequate. Although friction may fight 'flattening out' the curl on a large board once the edges are tacked to the transport belt. Any such 'long wave length/low frequency error' will produce image defects such as bowed lines in the cross process direction.

In answer to these problems and disclosed herein is the use of a series of low wetting star wheels positioned between staggered ink jet print heads to flatten corrugated media in conjunction with a vacuum transport belt and an acquisition cylinder to iron the curl out of the corrugated media in both the process and cross process directions.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1A:
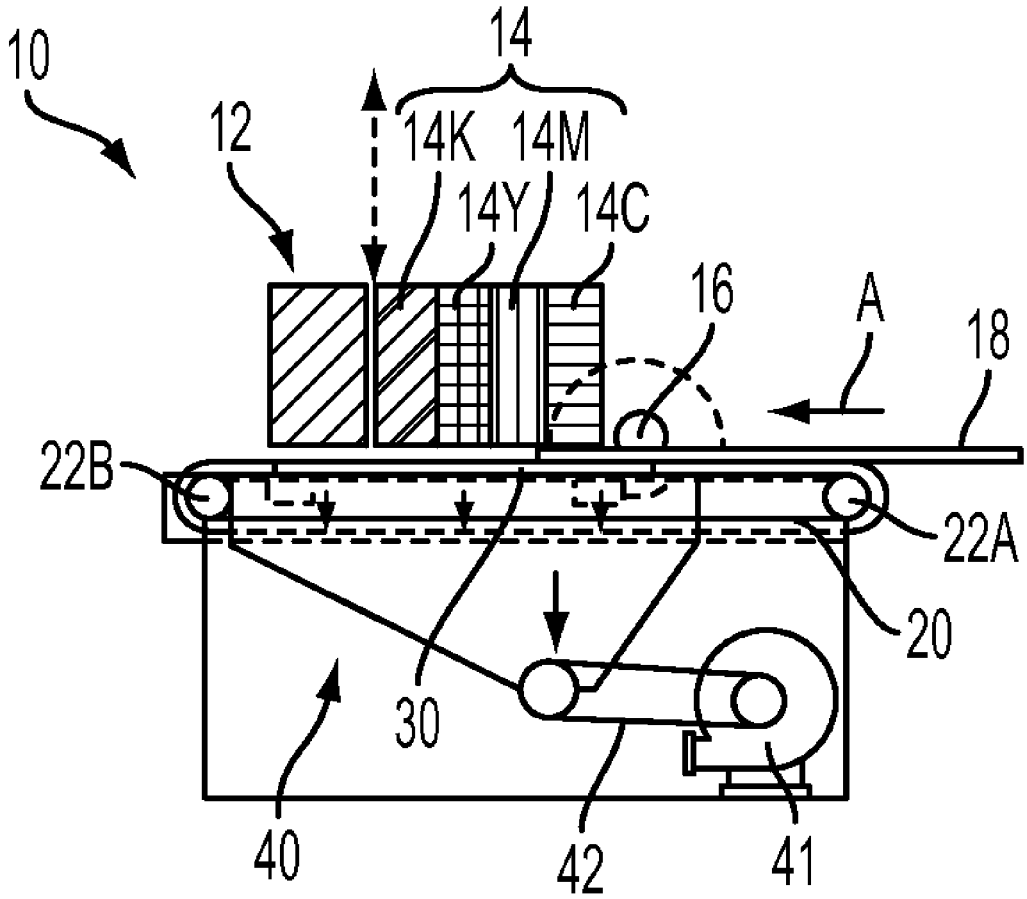
FIG. 1A is a partial schematic side view of an ink jet printer apparatus in accordance with the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment ink jet printing apparatus that includes a method and apparatus that flattens corrugated boards during transport through a printing zone.

For a general understanding of the features of the disclosure, reference is made to the drawings. In the drawings, like reference numerals have been used throughout to identify identical elements.

Referring now to printer 10 in FIG. 1A, the ink jet printer 10 includes an ink jet recording head 14 disposed above a conveyor belt 20. The ink jet recording head 14 is configured to be long, such that its effective recording area is equal to or greater than the cross process width of corrugated board 18. The ink jet recording head 14 includes four ink jet modules 14C, 14M, 14Y, 14K, which respectively, correspond to the four colors cyan (C), magenta (M), Yellow (Y), and black (K). If desired, the recording head 14 can contain multiple modules to print CMYK plus white, custom colors or UV overcoat. The ink jet modules 14C, 14M, 14Y, 14K are disposed along the conveyance direction; thus, the ink jet recording head 14 can record a full-color image. If UV curable inks are used, an ultraviolet curing station 12 is positioned downstream of the recording head.

The recording section adjacent the recording head includes an endless conveyor belt 20 that includes a number of small holes (not shown) therein and wound around a drive roller 22B disposed downstream in the paper conveyance direction A and a driven roller 22A disposed upstream in the paper conveyance direction A. The conveyor belt 20, which could be woven and/or porous, etc., is configured such that it is circulatingly driven by the drive and driven rollers. A vacuum plenum 40 is connected through conduit 42 to a vacuum source 41 and adapted to apply vacuum pressure to the holes in conveyor belt 20 in order to attach corrugated board 18 to the belt 20 sliding across the vacuum platen 30 during recording by the recording head 14.

The ink jet recording head 14 faces a flat portion of the conveyance belt 20 and this facing area serves as an ejection area to which ink droplets are ejected from the ink jet recording head 14. The corrugated board 18 is retained by the conveyor belt 20 and transported through the ejection region, where the ink droplets corresponding to an image are ejected from ink jet recording head 14 and onto the board 18 in a state where the board 18 faces the ink jet recording head 14.

Figure 1B:
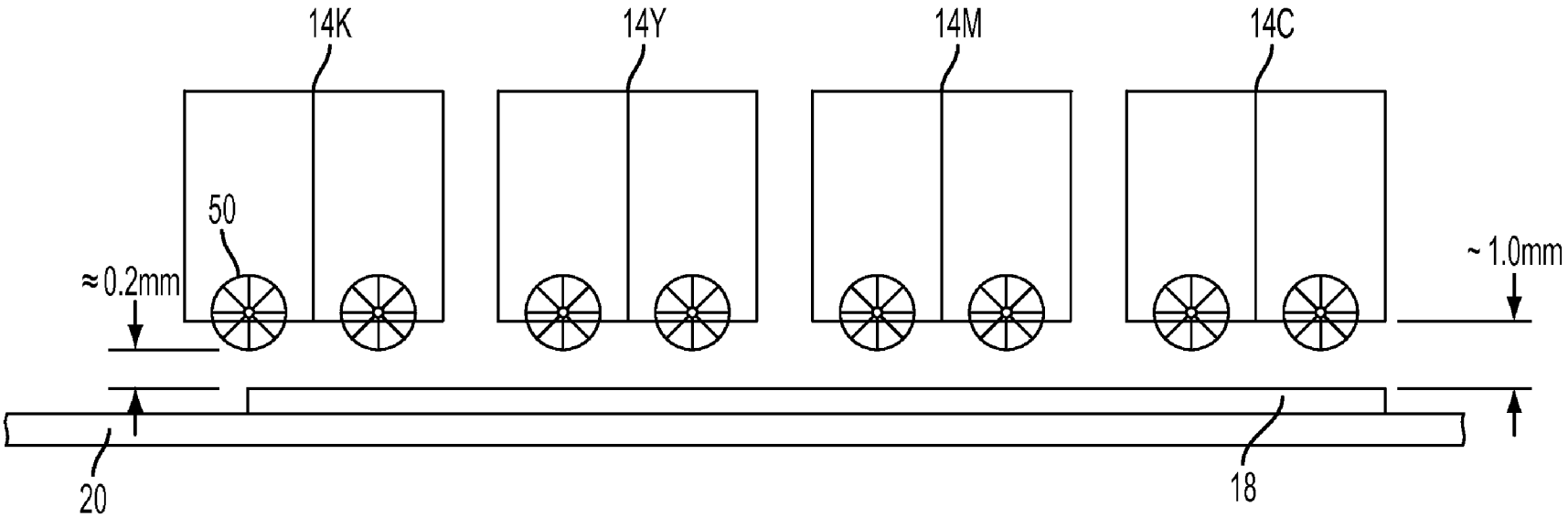
FIG. 1B is a partial schematic side view of the ink jet printer apparatus in FIG. 1A showing star wheels protruding from beneath a series of print head modules.
Figure 2:
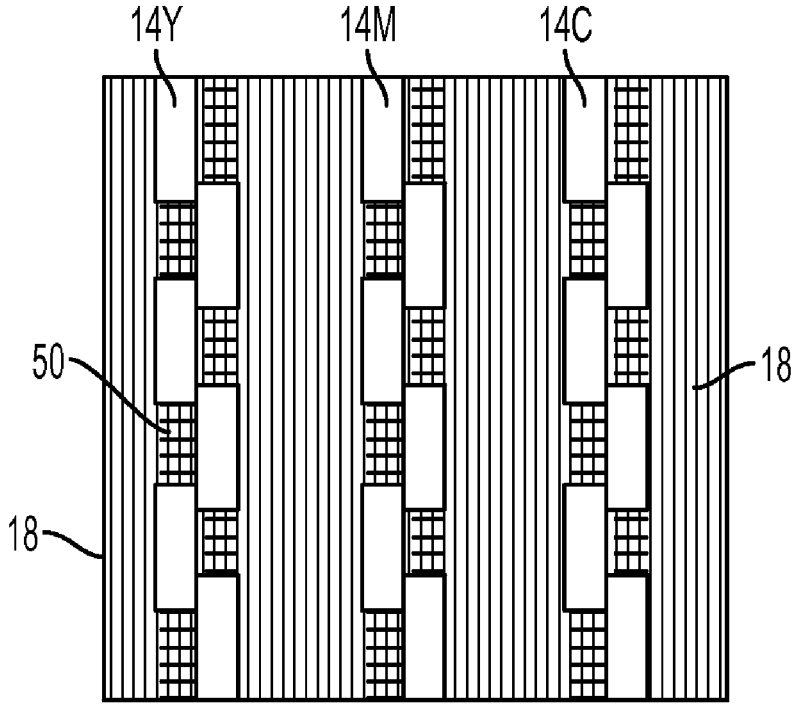
FIG. 2 is a partial plan view of the ink jet printer of FIG. 1A showing star wheels positioned between staggered print heads.

In order to maintain image quality and DoF between recording head 14 and corrugated boards beneath the recording head and in accordance with the present disclosure as shown in FIGS. 1A, 1B and 2, an acquisition cylinder 16 is positioned upstream of recording head 14 to help acquire control of board 18 and iron it flat against the vacuum belt 20 and vacuum platen 30 surfaces before it enters the print zone, thereby suppressing process and cross process curl. Hold down acquisition cylinder 16 is a statically loaded, floating, low pressure cylinder intended to flatten the lead edge of the board in cross process direction across the plenum platen 30 of vacuum transport 40 to enable lead acquisition and to establish a positive drive of the board as it enters the print zone, even before the board has had a chance to be forcibly acquired by the vacuum transport. The board is then held flat by vacuum belt 20 and vacuum plenum platen 30 through the print zone. Board lift-off from the vacuum belt 20 and vacuum platen 30 caused by curved, curled, bowed or distorted board is prevented with a series of star wheels 50 distributed throughout the print zone that suppress process and cross process curl. Star wheels are commonly used to control media lead and trail edges after image transfer and fusing processes or to guide media immediately following application of liquid ink to prevent image smears (e.g., U.S. Pat. No. 7,086,730). Surprisingly, it has now been found that star wheels can also be used as mechanical hold down mechanisms in the print zone and in close vicinity to liquid ink print heads provided they are low wetting, i.e., made of either of a non-wetting material and coating and of a particular geometry, such as, tapered cylindrical pins. The star wheels are mounted between staggered rows of print head modules 14C, 14M, 14Y and 14K shown in FIG. 1B to protrude below the plane of recording head 14 by a large percentage (~80%) of the nominal DoF gap to control the print head to media gap and to suppress process direction curl. Preferably, the print modules are located about 1.0 mm above print media with the star wheels being positioned about 0.2 mm above the surface of the print media. The tiny points of star wheel 50 enter and exit the ink image without disturbing the image or wetting the star points due to geometry, material and kinematics and are loaded at about 1.85 N/wheel or less to avoid penetrating the board liner. Board deflection analysis has shown that applying 1.85 N load on wheels uniformly spaced every 50 mm, for example, will deflect a 900 mm square sheet of B flute corrugated media far in excess of any practical or anticipated levels of bow or curl and hold the corrugated media flat against conveyor belt 20.

Figure 3:
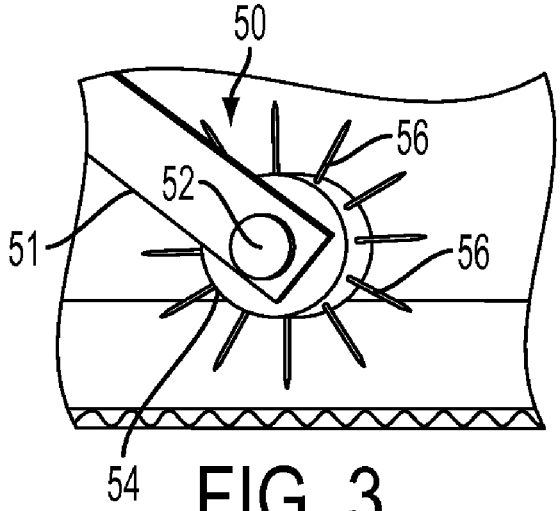
FIG. 3 is a partial isometric view of a star wheel used in FIG. 2.
Figure 4:
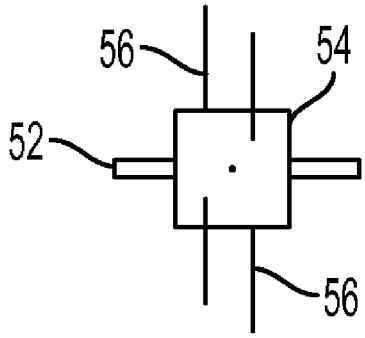
FIG. 4 is a top view of one possible geometry of one of the star wheels used in FIG. 2 showing the staggered spacing between pins extending from the hub of the star wheel.
Figure 5:
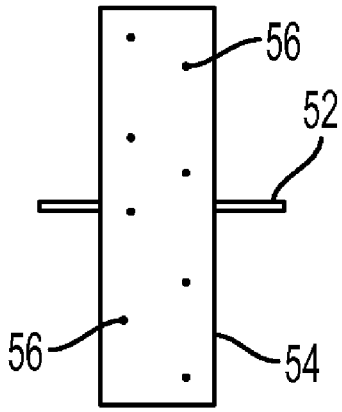
FIG. 5 is a plan view of the circumferential periphery of the star wheel of FIG. 4 showing the hub circumference unrolled and the staggered pin pattern.

Star wheels 50 as shown in FIGS. 3-5 include pins 56 mounted on a hub 54 that is preferably small in diameter and plastic for low inertia. The series of star wheels act as positive DoF spacers and limit the proximity of the corrugated media to the recording head 14. Hub 54 is preferably mounted on a wire shaft 52. Multiple pins 56 are shown attached to the hub in several planes to avoid a single row of tracks and are about 1.1 mm in diameter and tapered to avoid a flat surface and be less prone to wetting by the inks than traditional sheet metal star wheels. The pins are coated with a non-wetting material, such as Teflon®, to further reduce the possibility of ink wetting and contamination of the pin. The staggered alignment of pins 56 in FIGS. 4 and 5 serves to scatter any potential contact defect rows through the image. The staggered alignment also ensures more than one pin is in contact with the board at all times to maintain uniform motion between the star wheel and the board and prevent the pins from smearing the image.

It should now be understood that a solution for low frequency DoF control errors in ink jet printing onto corrugated media has been disclosed that includes employing a vacuum transport in combination with an acquisition cylinder positioned shortly before corrugated media reaches a series of staggered ink jet print head modules and star wheels distributed about and positioned between the staggered ink jet print head modules and protruding below the staggered print head modules to flatten corrugated media and thereby improve image quality.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An ink jet recording apparatus that conducts image recording by ejecting ink from a series of staggered rows of print head modules onto corrugated recording media within a print zone includes a system for maintaining depth of focus in the print zone between the print head modules and the corrugated recording media, comprising:

a vacuum transport, said vacuum transport including a belt module having a belt support for supporting a movable continuous belt that conveys the recording media through the print zone and a vacuum plenum connected to a vacuum source, said vacuum plenum including a plenum plate covering said vacuum plenum and facing an underside portion of said continuous belt such that vacuum pressure can be applied to corrugated recording media carried by said belt module;

an acquisition cylinder positioned immediately upstream of said series of staggered rows of print head modules and adapted to iron out process and cross process direction curl and assist said vacuum transport in acquiring control of the corrugated recording media; and a series of star wheels mounted between and beside each of said series of staggered rows of print head modules in a widthwise direction, said star wheels protruding below a print head plane of said staggered rows of print head modules in order to control the print head to media gap and to suppress process direction curl.

2. The ink jet recording apparatus of claim 1, wherein said acquisition cylinder is statically loaded.

3. The ink jet recording apparatus of claim 2, wherein said star wheels are loaded at about 1.85 N/wheel.

4. The ink jet recording apparatus of claim 3, wherein each of said star wheels includes a series of pins with each pin having a diameter of about 1.1 mm.

5. The ink jet recording apparatus of claim 4, wherein said pins are mounted on a plastic hub.

6. The ink jet recording apparatus of claim 5, wherein said pins are in staggered rows on said hub.

7. The ink jet recording apparatus of claim 6, wherein said pins are tapered.

8. The ink jet recording apparatus of claim 7, wherein said pins are coated with a non-wetting material.

9. The ink jet recording apparatus of claim 8, wherein said pins are positioned on said hub in at least two different and radial offset vertical planes.

10. The ink jet recording apparatus of claim 6, wherein said staggered rows of said pins on said hub ensures that more than one pin is in contact with the corrugated recording media at all times to maintain uniform motion between said star wheels and the corrugated recording media and prevent said pins from smearing an image during image recording.

11. The ink jet recording apparatus of claim 4, wherein each of said star wheels are uniformly spaced about 50 mm across the width of said print zone.

12. The ink jet recording apparatus of claim 1, wherein said print head modules are located about 1.0 mm above the corrugated recording media.

13. The ink jet recording apparatus of claim 4, wherein a tip portion of each of said pins of said star wheels is positioned about 0.2 mm above the corrugated recording media.

14. The ink jet recording apparatus of claim 6, wherein said staggered rows of pins serve to scatter any potential contact defect rows throughout image recording.

15. The ink jet recording apparatus of claim 1, wherein said print head modules include at least cyan, magenta, yellow and black inks.

16. An ink jet printing apparatus that conducts image recording by ejecting ink from a series of print head modules onto corrugated recording media within a print zone including a vacuum transport, said vacuum transport including a belt module having a belt support for supporting a movable continuous belt that conveys the recording media through the print zone and a vacuum plenum connected to a vacuum source, said vacuum plenum including a plenum plate covering said vacuum plenum and facing an underside portion of said continuous belt such that vacuum pressure can be applied to corrugated recording media carried by said belt module, said ink jet printing apparatus including a system for maintaining depth of focus in the print zone between the print head modules and the corrugated recording media, comprising:

an acquisition cylinder positioned immediately upstream of said print head modules and adapted to iron out process and cross process direction curl and assist said vacuum transport in acquiring control of the corrugated recording media; and a series of star wheels mounted in-line with and beside each of said print head modules, said star wheels protruding below a print head plane of said print head modules in order to control the print head to media gap and to suppress process direction curl.

17. The ink jet printing apparatus of claim 16, wherein said series of print head modules are in staggered rows.

18. The ink jet printing apparatus of claim 17, wherein said series of star wheels are mounted between said series of staggered rows of print head modules and in-line in a widthwise direction with said series of staggered rows of print head modules in spaces between said print head modules created by staggering said print heads modules.

19. The ink jet printing apparatus of claim 18, wherein each of said star wheels includes a series of pins with each pin having a diameter of about 1.1 mm.

* * * * *